US010639926B2

(12) United States Patent
Nielson

(10) Patent No.: US 10,639,926 B2
(45) Date of Patent: May 5, 2020

(54) COMPACT WRITING INSTRUMENT

(71) Applicant: Thomas Aten Nielson, Lamoille, NV (US)

(72) Inventor: Thomas Aten Nielson, Lamoille, NV (US)

(73) Assignee: Thomas Aten Nielson, Lamoille, NV (US)

( * ) Notice: Subject to any disclaimer, the term of this patent is extended or adjusted under 35 U.S.C. 154(b) by 0 days.

(21) Appl. No.: 15/976,810

(22) Filed: May 10, 2018

(65) Prior Publication Data

US 2019/0111726 A1 Apr. 18, 2019

Related U.S. Application Data

(60) Provisional application No. 62/504,510, filed on May 10, 2017.

(51) Int. Cl.

| | |
|---|---|
| ***B43K 25/02*** | (2006.01) |
| ***B43K 7/00*** | (2006.01) |
| ***B43K 5/00*** | (2006.01) |
| ***B43K 24/04*** | (2006.01) |
| ***B43K 23/08*** | (2006.01) |
| ***B43K 23/12*** | (2006.01) |

(52) U.S. Cl.

CPC ..... *B43K 23/126* (2013.01); *B43K 5/005* (2013.01); *B43K 7/005* (2013.01); *B43K 25/022* (2013.01); *B43K 23/08* (2013.01); *B43K 24/04* (2013.01)

(58) Field of Classification Search

CPC ..... B43K 24/06; B43K 25/022; B43K 5/16; B43K 7/005; B43K 7/12; B43K 5/005; B43K 23/08; B43K 23/10; B43K 23/12; B43K 12/126; B43K 25/02; B43K 25/028; B43K 24/04

See application file for complete search history.

(56) References Cited

U.S. PATENT DOCUMENTS

| | | | | | |
|---|---|---|---|---|---|
| 1,850,086 | A * | 3/1932 | Segal | B43K 25/022 | 24/11 F |
| 5,174,672 | A * | 12/1992 | Towsend | B43K 23/004 | 401/131 |
| 5,221,152 | A * | 6/1993 | Chuang | B43K 23/10 | 15/427 |
| 5,993,098 | A * | 11/1999 | Osada | B43K 7/01 | 401/209 |

(Continued)

*Primary Examiner* — David J Walczak

(74) *Attorney, Agent, or Firm* — Durham Jones & Pinegar, P.C. Intellectual Property Law Group

(57) ABSTRACT

A writing instrument includes a barrel and a cap capable of being assembled with and secured to the barrel. The barrel carries a writing instrument. The cap carries a clip. A free end of the clip includes a detent that can be received by a corresponding indentation of an exterior surface of an external portion of the barrel when the cap is assembled with the barrel. The detent of the clip and the indentation of the barrel are capable of securing the cap and the barrel in their assembled relationship. The writing instrument may be compact. Methods of using a writing instrument include securing a cap of the writing instrument to a barrel of the writing instrument by causing a detent of a free end of a clip of the cap to engage a corresponding indentation of an exterior portion of the barrel.

9 Claims, 3 Drawing Sheets

(56) References Cited

U.S. PATENT DOCUMENTS 6,264,389 B1 * 7/2001 Ducharme ..... B43K 23/08
401/107
6,616,365 B1 * 9/2003 Vann ..... B43K 24/023
401/117

* cited by examiner

COMPACT WRITING INSTRUMENT

CROSS-REFERENCE TO RELATED APPLICATION

A claim for priority to the May 10, 2017 filing date of U.S. Provisional Patent Application No. 62/504,510, titled POCKET-KEYRING ("the '510 Provisional Application"), is hereby made pursuant to 35 U.S.C. § 119(e). The entire disclosure of the '510 Provisional Application is hereby incorporated herein.

TECHNICAL FIELD

This disclosure relates generally to writing instruments, including compact writing instruments. More specifically, this disclosure relates to writing instruments with a barrel and a cap that may be secured together by a clip on the cap. Even more specifically, a clip may extend beyond an end of the cap, and a detent at or near a free end of the clip may engage a complementary indentation of an outer surface of an external portion of the barrel. Methods for using writing instruments are also disclosed.

SUMMARY

In various embodiments, a writing instrument according to this disclosure includes a barrel and a cap. The barrel carries a writing element that may be used in a manner known in the art, as well as a body that carries the writing element. The body of the barrel includes a first portion from which the writing element protrudes. The first portion may also be referred to herein as an "insertion portion" of the body of the barrel. The writing element and/or the insertion portion may have a configuration that enables the writing element to be extended outwardly from and retracted toward the insertion portion of the body. An exterior surface of the insertion portion of the body of the barrel may include one or more cap engagement features.

A second portion of the body of the barrel, which is located opposite from the insertion portion of the body of the barrel, may also be referred to as an "external portion" of the barrel. An exterior surface of the external portion may include an indentation. In some embodiments, the indentation may extend circumferentially around the exterior surface of the external portion of the barrel.

The cap of the writing instrument includes a body and a clip. The body of the cap includes an open first end, which is continuous with an interior of the body, and which is capable of receiving the writing element and the insertion portion of the body of the barrel, from which the writing element protrudes. The interior of the body of the cap, at a location at or adjacent to the first end of the body of the cap, may include one or more barrel engagement features. The barrel engagement feature(s) may be configured complementarily to the corresponding cap engagement feature(s) of on the exterior surface of the external portion of the body of the barrel to enable the cap to engage the barrel when the cap is assembled with the barrel.

A second end of the body of the cap may be closed. An attachment end of the may be secured to the cap at or near the second end of the cap. The clip extends along at least a portion of a length of the body of the cap. A gap between the clip and the body of the cap can receive an element (e.g., a shirt pocket, a pants pocket, a retainer on a clipboard or folio, a legal pad, etc.). When the cap of the writing instrument is assembled with the barrel of the writing instrument, a configuration of a free end of the clip (i.e., the end that enables the element to be introduced between a length of the clip and the cap) may enable it to capture the element between a free end of the clip and a corresponding location on the body of the cap or a corresponding location of the body of the barrel.

The clip may extend to a location beyond a first end of the body of the cap. The free end of such a clip may include a protruding feature, such as a detent, that is capable of being introduced into and, thus, engaging the indentation of the exterior surface of the external portion of the body of the barrel of the writing instrument. Such an arrangement may enable the clip to at least partially secure the cap and the barrel in their assembled relationship. When engagement features of the cap and the barrel secure these two elements to each other, the detent of the clip and the indentation of the body of the barrel may ensure that the cap and the barrel remain in their assembled relationship.

A method of using such a writing instrument may include disengaging a cap of the writing instrument from a barrel of the writing instrument to expose a writing element of the barrel. As the cap disengages the barrel, a detent or another protrusion at or adjacent to a free end of a clip of the cap may be forced out of a corresponding indentation of an exterior surface of an external portion of the barrel. With the cap disengaged from the barrel, a writing element of the writing instrument may be removed from an interior of the cap. In some embodiments, including those where the writing instrument is a compact writing instrument, the writing element may also be extended from a body of the barrel (e.g., telescopically, rotationally, etc.) to extend the length of the barrel, potentially making it easier to use. Once the writing element has been removed from the cap and optionally extended from the body of the barrel of the writing instrument, it may be used in a manner known in the art (e.g., for writing, drawing, etc.). Once use of the writing instrument is complete, a previously extended writing element may be retracted, and the writing element and a portion of the barrel from which the writing element protrudes may be introduced into the interior of the cap. The cap may then engage the barrel and, while engaging the barrel, the detent at or near the free end of the clip may be introduced into and engage the indentation in the exterior surface of the external portion of the barrel, securing the cap in place on the barrel.

Other aspects of the disclosed subject matter, as well as features and advantages of various aspects of the disclosed subject matter, will become apparent to those of ordinary skill in the art through consideration of the ensuing disclosure, the accompanying drawings and the appended claims.

DETAILED DESCRIPTION

Figure 1:
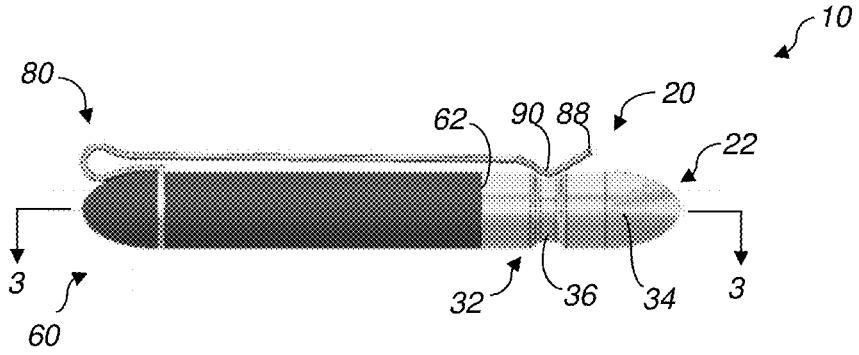
FIG. 1 is a side view of an embodiment of a writing instrument according to this disclosure, showing the writing instrument in an assembled orientation, with a cap of the writing instrument in place over part of a barrel of the writing instrument.
Figure 2:
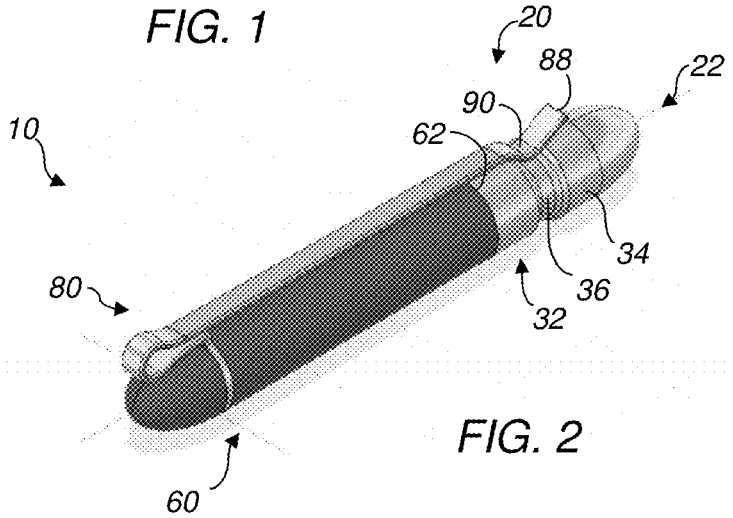
FIG. 2 is an orthogonal view of the writing instrument shown in FIG. 1.
Figure 3:
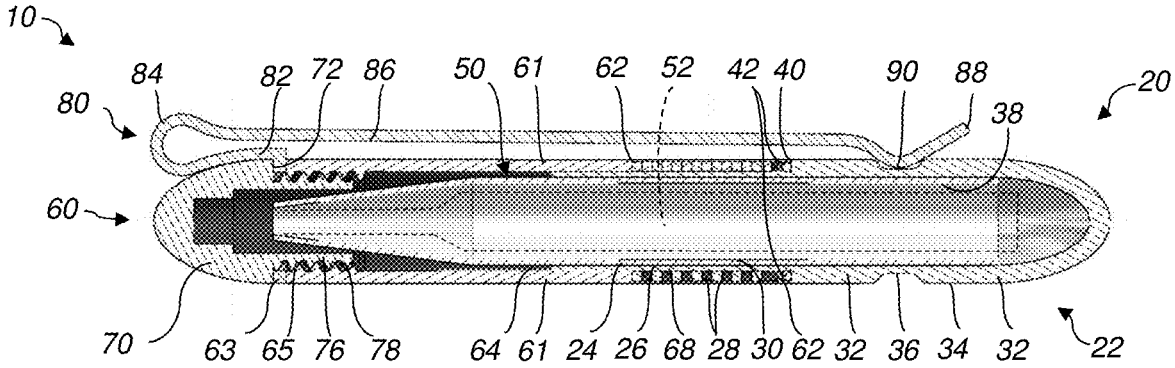
FIG. 3 is a cross-section through line 3-3 of FIG. 1, illustrating how various features of the cap and the barrel of the writing instrument interact while the cap and the barrel are in the assembled relationship.

FIGS. 1-3 depict an embodiment of a writing instrument 10 that includes a barrel 20 and a cap 60. In FIGS. 1-3, the cap 60 and the barrel 20 are in an assembled relationship, in which the cap 60 is positioned over a portion of the barrel 20 and the cap 60 engages the barrel 20. Notably, the cap 60 includes a clip 80 with a free end 88 that extends beyond a corresponding open end 62 of the cap 60. The clip 80 includes protruding feature, which is referred to herein as a "detent 90," at or near the free end 88. The detent 90 is capable of engaging an indentation 36 of an exterior surface 34 of an external portion 32 of a body 22 of the barrel 20.

As illustrated by FIG. 3, the barrel 20 of the writing instrument 10 includes the aforementioned body 22, which carries a writing element 50. More specifically, the body 22 may include an insertion portion 24 and a second portion—the external portion 32. The indentation 36 in the exterior surface 34 of the external portion 32 may comprise a circumferential indentation that extends substantially or even completely around the exterior surface 34 of the external portion 32.

Figure 4:
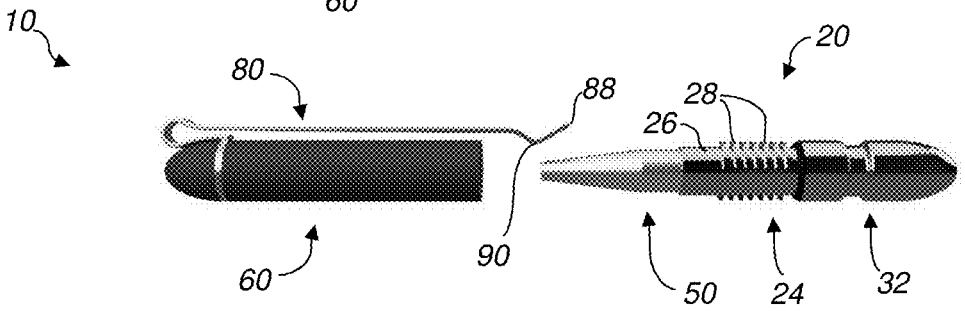
FIG. 4 is a side view of the writing instrument of FIG. 1, showing the cap disassembled from the barrel to expose a writing element of the barrel; the writing element is in a retracted, or collapsed, orientation relative to a body of the barrel.
Figure 5:
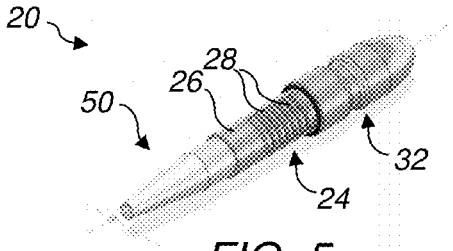
FIG. 5 is an orthogonal view of the barrel of the writing instrument shown in FIG. 1 with the writing element in the retracted, or collapsed, orientation shown in FIG. 4.
Figure 6:
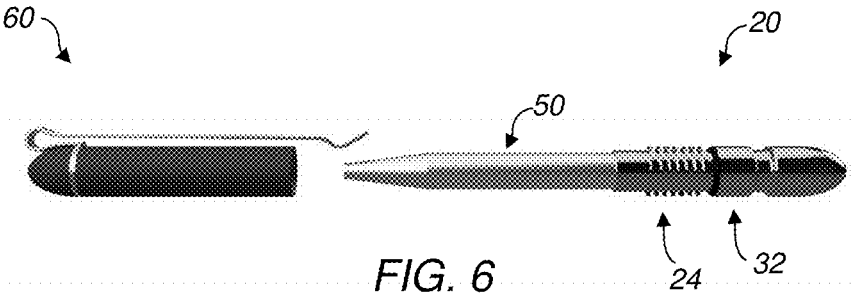
FIG. 6 is a side view of the writing instrument of FIG. 1, showing the cap disassembled from the barrel, and the writing instrument of the barrel in an extended orientation relative to the body of the barrel.
Figure 7:
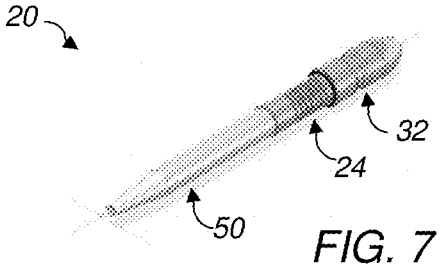
FIG. 7 is an orthogonal view of the barrel of the writing instrument shown in FIG. 1 with the writing element in the extended orientation shown in FIG. 6.

The insertion portion 24 of the body 22 of the barrel 20 may include a receptacle 30 that receives the writing element 50. The external portion 32 may also include a receptacle 38, which may be continuous with the receptacle 30 of the insertion portion 24, and which may also receive a portion of the writing element 50. One or both of the receptacles 30 and 38 may retain the writing element 50 in any suitable manner known in the art. For example, the receptacle 38 and the writing element 50 may have complementary configurations that enable the writing element 50 to be disassembled from the body 22 of the barrel 20 to enable refilling and/or replacement of the writing element 50. As another example, one or both of the writing element 50 and the receptacle 30/38 may have configurations that enable the writing element 50 to be extended from and retracted toward, or collapsed relative to, the body 22 of the barrel 20 (e.g., they may include features that enable the writing element 50 to telescope relative to the body 22; they may include features that enable the writing element 50 to be rotatably extended from and retracted toward the body 22, etc.). FIGS. 4 and 5 show the writing element 50 in a retracted orientation relative to the body 22. FIGS. 6 and 7 show the writing element 50 in an extended orientation relative to the body 22. When the writing element 50 is in its extended orientation, the barrel may have a length of about 3 inches or more (e.g., 3 inches, 3¼ inches, 3½ inches, 3¾ inches, 3.9 inches, 4 inches, etc.).

The writing element 50 itself may comprise a pen (e.g., a ball point pen, a gel pen, a fountain pen, etc.), a mechanical pencil, a stylus (for writing on a display screen (e.g., a touch-sensitive display screen, etc.) or an electronic device, or any other suitable type of writing instrument. In a specific, but nonlimiting embodiment, the writing element 50 may be capable of carrying a pressurized pen refill 52. The pressurized pen refill 52 may have a length as short as two inches or less.

Figure 8:
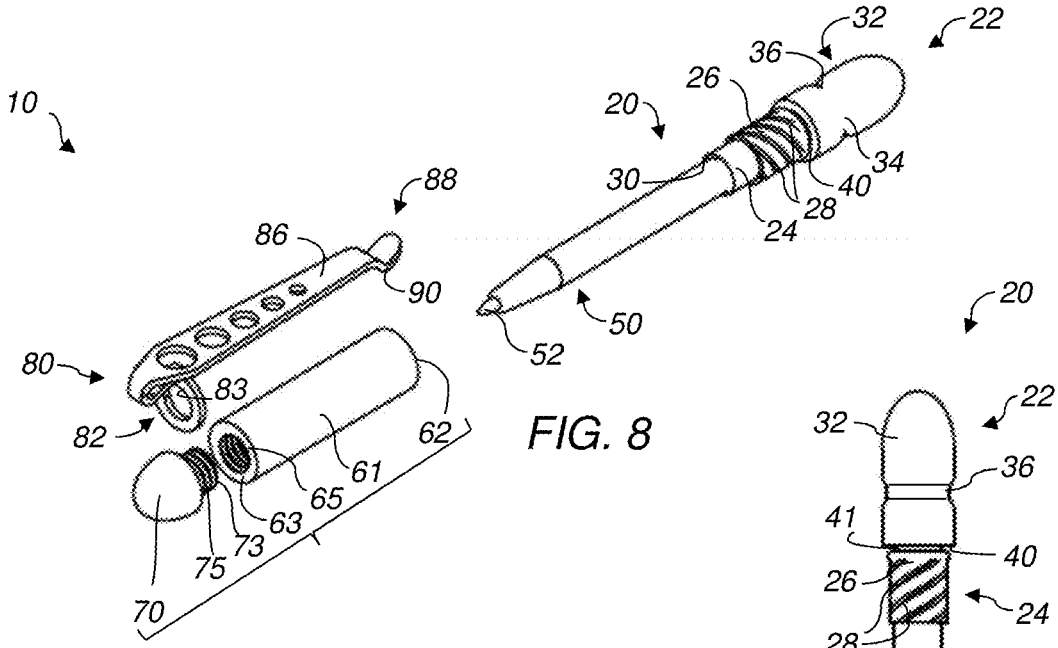
FIG. 8 is an orthogonal exploded view of an embodiment of writing instrument according to this disclosure.
Figure 9:
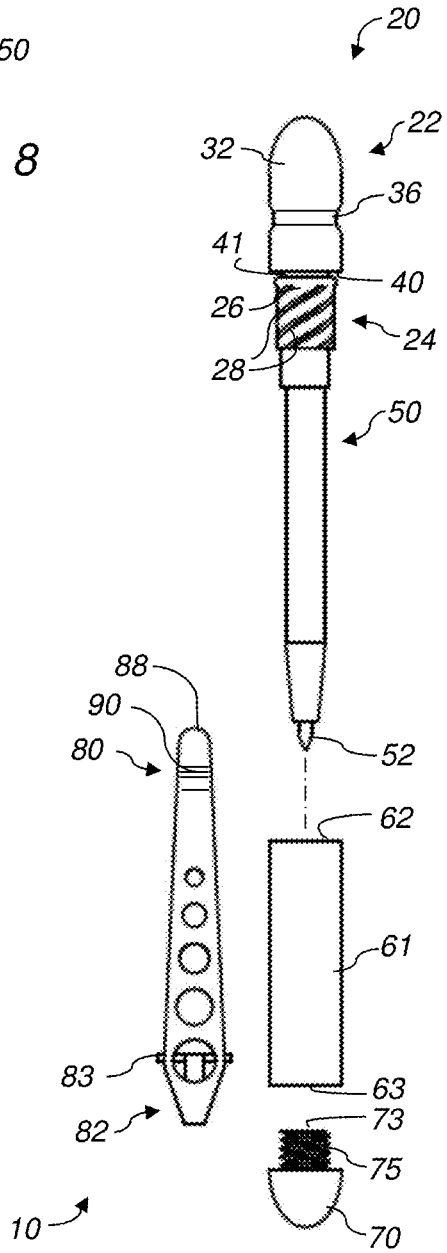
FIG. 9 is a front exploded view of the embodiment of writing instrument shown in FIG. 8.

With continued reference to FIG. 3, along with reference to FIGS. 8 and 9, a circumferential ledge 40 is formed at a transition between the exterior portions of the external portion 32 of the body 22 of the barrel 20 and the insertion portion 24 of the body 22 of the barrel 20. The circumferential ledge 40 is defined by differences between the outer diameters of the insertion portion 24 and a location of the external portion 32 located adjacent to the insertion portion 24. More specifically, an outer diameter of the insertion portion 24 may enable it to be received by an interior 64 of the cap 60, while the outer diameter of the external portion 32 adjacent to the circumferential ledge 40 may be larger than the outer diameter of the insertion portion 24. In some embodiments, the outer diameter of the external portion 32 adjacent to the insertion portion 24 may be the same as an outer diameter the cap 60 adjacent to its open end 62.

The circumferential ledge 40 may limit the extent to which the writing element 50 and the insertion portion 24 of the body 22 of the barrel 20 may be inserted into the interior 64 of the cap 60. When the cap 60 is assembled with the barrel 20, the circumferential ledge 40 of the body 22 of the barrel 20 may abut an edge at the open end 62 of the cap 60. Alternatively, the circumferential ledge 40 of the body 22 of the barrel 20 and the edge at the open end 62 of the cap 60 may merely be positioned adjacent to one another when the cap 60 and the barrel 20 are in their assembled relationship.

As depicted by FIG. 9, the insertion portion 24 of the body 22 of the barrel 20 may include a groove 41 recessed circumferentially adjacent to the circumferential ledge 40. The groove 41 may be capable of receiving a sealing element, such as the O-ring 42 shown in FIG. 3. As an alternative to seating the O-ring 42 within such a groove 41, an O-ring 42 may be merely placed around the exterior surface 26 of the insertion portion 24 at a location adjacent to the circumferential ledge 40. In any event, the O-ring 42 may enable the edge at the open end 62 of the cap 60 to seal against the circumferential ledge 40 and/or the groove 41, which may seal the writing element 50 within the interior 64 of the cap 60. Sealing of the writing element 50 within the cap 60 may prevent ink from leaking out of a pen onto an individual's clothing. Sealing of the writing element 50 within the cap 60 may also prolong the useful life of the writing element 50.

As illustrated by FIGS. 3-9, the outer surface 26 of the insertion portion 24 of the body 22 of the barrel 20 may include one or more cap engagement features 28 that enable the cap 60 to be coupled to the barrel 20. The cap engagement features 28 may comprise any suitable cap engagement features known in the art known in the art (e.g., recesses, protrusions, threads, interference fitting surfaces, etc.). In a specific embodiment, the cap engagement features 28 may comprise a circumferentially arranged series of helical threads. Each thread may extend around the outer surface 26 of the insertion portion 24 and, thus, around a circumference of the insertion portion 24 a maximum of one turn (e.g., about one turn, about half a turn, etc.).

Referring to FIG. 3, the interior 64 of the cap 60, at a location adjacent to the open end 62, may include one or more corresponding barrel engagement features 68. Each barrel engagement feature 68 may be configured complementarily to a corresponding cap engagement feature 28 on the outer surface 26 of the insertion portion 24 of the body 22 of the barrel 20. In embodiments where the barrel engagement feature(s) 68 is (are) configured to engage or to be engaged by helical cap engagement feature(s) 28 that extend one turn or less around the exterior surface 26 of the insertion portion 24, the cap 60 may be secured to the barrel 20 by one twist or less (e.g., a single twist, or 360°; a half twist, or 180°; etc.).

FIGS. 1, 4, 6, 8, and 9 depict the clip 80 of the cap 60. As shown in FIGS. 3, 8, and 9, the clip 80 includes an attachment end 82, an extending portion 86, and the aforementioned free end 88. The attachment end 82 is secured to a remainder of the cap 60. While the attachment end 82 may be secured to the remainder of the cap 60 in any suitable manner, FIG. 3 depicts an embodiment in which the attachment end 82 is secured between a body 61 and a tip 70 of the cap 60. More specifically, the tip 70 may include an engagement element 76 of reduced diameter that may extend through the attachment end 82 of the clip 80, with the attachment element abutting a ledge 72 that extends circumferentially around the tip 70. The engagement element 76 may be inserted through an opening in a top end 63 of the body 61 and into the interior 64 of the body 61. An engagement feature 78 of the engagement element 76 (e.g., a helical thread, etc.) may engage a complementary engagement element 65 (e.g., a helical thread, etc.) carried by a portion of the interior 64 of the body 61 at a location adjacent to the top end 63 of the body 61. As the tip 70 of the cap 60 is secured to the body 61 of the cap 60, the attachment end 82 of the clip 80 is sandwiched between the ledge 72 of the tip 70 and the top end 63 of the body 61.

The clip 80 may include an enlarged receptacle 84 at or near its attachment end 82. The enlarged receptacle 84 may enable the clip 80 to receive and be secured to a split key ring, a chain, a clip on a lanyard, or any other suitable carrying element. The carrying element may be introduced into the enlarged receptacle 84 simply by pulling the free end 88 and the extending portion 86 of the clip 80 away from the body 61 of the cap 60, introducing the carrying element between the extending portion 86 and the body 61, sliding the carrying element along the extending portion 86 until the carrying element reaches the enlarged receptacle 84, and allowing the extending portion 86 to return to a resting position nearer to the body 61. While the enlarged receptacle 84 may receive the carrying element, a thickness of the carrying element and a distance between the extending portion 86 and the body 61 while the clip 80 is in a relaxed state may trap the carrying element within the enlarged receptacle 84, preventing the carrying element from sliding back along the extending portion 86.

The extending portion 86 of the clip 80 may extend along at least a portion of the length of the cap 60 to a location beyond the open end 62 of the cap 60. Thus, the free end 88 of the clip 80 may be located beyond the open end 62 of the cap 60. At its free end 88, the clip 80 may include a detent 90, which may protrude in a direction that will enable it to be received by and, thus, to engage the indentation 36 of the exterior surface 34 of the external portion 32 of the body 22 of the barrel 20, as depicted by FIGS. 1 and 3.

When the cap 60 is assembled with the barrel 20, the writing instrument 10 may have a length of about 3 inches or less (e.g., 3 inches, 2¾ inches, 2½ inches, 2¼ inches, etc.). Such a length may render the writing instrument 10 small enough to be completely inserted into virtually any pocket, including, without limitation, the watch pockets that are commonly found on the right front panels of jeans and other types of pants.

In a method of use, the writing instrument 10 may be provided with the cap 60 in an assembled relationship on the insertion portion 24 of the body 22 of the barrel 20, as depicted by FIGS. 1-3. The cap 60 may be removed from, or disengaged from, the barrel 20 (e.g., by rotating one or both of the cap 60 and the barrel 20, by pulling the cap 60 away from the barrel 20, etc.). As the cap 60 disengages the barrel 20, the detent 90 of the clip 80 may be forced out of the corresponding indentation 36 of the exterior surface 34 of the external portion 32 of the body 22 of the barrel 20. With the cap 60 disengaged from the barrel 20, the writing element 50 carried by the barrel 20 may be removed from an interior 64 (FIG. 3) of the cap 60, as shown in FIGS. 4 and 5. The writing element 50 may then be extended from a remainder of the barrel 20 (e.g., telescopically, rotationally, etc.) as illustrated by FIGS. 6 and 7. Once the writing element 50 has been removed from the cap 60 and optionally extended from the body 22 of the barrel 20, the writing element 50 may be used in a manner known in the art (e.g., for writing, drawing, etc.).

Once use of the writing instrument 10 is complete, a previously extended writing element 50 may be retracted relative to the body 22 of the barrel 20, as depicted by FIGS. 4 and 5, and the writing element 50 and the insertion portion 24 of the body 22 of the barrel 20 may be may be introduced into the interior 64 of the cap 60, as shown in FIGS. 1-3. The cap 60 may then engage the barrel 20 and, while engaging the barrel 20, the detent 90 of the clip 80 may be introduced into and engage the indentation 36 of the exterior surface 34 of the external portion 32 of the body 22 of the barrel 20, further securing the cap 60 in place on the barrel 20 and ensuring that an O-ring 42 creates a seal between the open end 62 of the cap 60 and the body 22 of the barrel 20.

Although the foregoing description sets forth many specifics, these should not be construed as limiting the scope of any of the claims, but merely as providing illustrations of some embodiments and variations of elements or features of the disclosed subject matter. Other embodiments of the disclosed subject matter may be devised which do not depart from the spirit or scope of any of the claims. Features from different embodiments may be employed in combination. Accordingly, the scope of each claim is limited only by its plain language and the legal equivalents thereto.

What is claimed:

1. A writing instrument, including:

a barrel with:

a writing element;

a body including:

a first portion from which the writing element protrudes and telescopes, an exterior surface of the first portion including a cap engagement feature; and a second portion opposite from the first portion, an exterior surface of the second portion including an indentation; and a cap with:

a body including a first end, an interior, and a second end, the first end opening to the interior, the first end and the interior capable of receiving the writing element and the first portion of the body of the barrel to place the cap and the barrel in an assembled relationship, an interior surface of the body of the cap including a barrel engagement feature that engages the cap engagement feature of the body of the barrel; and a clip including an attachment end secured to the cap adjacent to the second end of the cap and a free end, the free end including a detent capable of automatically engaging the indentation of the body of the barrel upon placement of the first portion of the barrel in the first end of the body of the cap and causing the barrel engagement feature of the cap to engage the cap engagement feature of the barrel.

2. The writing instrument of claim 1, wherein the writing element is capable of telescoping to extend a length of the barrel three inches or more.

3. The writing instrument of claim 1, wherein the cap engagement feature and the barrel engagement feature comprise complementary threads arranged to enable the cap to be secured to the barrel in the assembled relationship by rotating the cap or the barrel 360° or less.

4. The writing instrument of claim 3, wherein the cap engagement feature comprises a series of helical threads arranged parallel to one another, each helical thread of the series of helical threads of the cap engagement feature of the barrel extending no more than once around a circumference of the exterior surface of the second portion of the body of the barrel.

5. The writing instrument of claim 1, wherein the cap engagement feature and the barrel engagement feature comprise complementary threads arranged to enable the cap to be secured to the barrel in the assembled relationship by rotating the cap or the barrel 180° or less.

6. The writing instrument of claim 1, wherein the cap and the barrel, when in the assembled relationship, have a length of about 2½ inches or less.

7. The writing instrument of claim 6, wherein the writing element is capable of receiving a pressurized ink refill.

8. A method for using a writing instrument, comprising:

disengaging a cap of the writing instrument from a barrel of the writing instrument to expose a writing element of the barrel, including disengaging a detent of a clip of the cap from an indentation in the barrel;

removing the writing element of the barrel from an interior of the cap;

extending the writing element from the barrel after removing the writing element of the barrel from the interior of the cap and before using the writing element;

using the writing element;

introducing the writing element into the interior of the cap;

causing the cap to engage the barrel; and retracting the writing element at least partially into an interior of the barrel after using the writing element and before introducing the writing element into the interior of the cap.

9. The method of claim 8, wherein disengaging the cap comprises unscrewing the cap from the barrel.

* * * * *